United States Patent [19]

Standing et al.

[11] 4,133,896

[45] Jan. 9, 1979

[54] FOOD PACKAGE INCLUDING CONDIMENT CONTAINER FOR HEATING FOOD

[75] Inventors: Charles N. Standing; Lawrence C. Brandberg, both of Minneapolis, Minn.

[73] Assignee: The Pillsbury Company, Minneapolis, Minn.

[21] Appl. No.: 871,889

[22] Filed: Jan. 24, 1978

Related U.S. Application Data

[63] Continuation of Ser. No. 656,560, Feb. 9, 1976, abandoned, which is a continuation of Ser. No. 456,924, Apr. 1, 1974, abandoned.

[51] Int. Cl.[2] ..... B65B 29/08; B65B 25/22

[52] U.S. Cl. ..... 426/107; 219/10.55 D; 219/10.55 E; 426/120; 426/113; 426/234; 426/412

[58] Field of Search ..... 426/106, 107, 234, 241, 426/242, 243, 113, 114, 185, 124, 128, 129, 412, 393, 120; 219/10.55 D, 10.55 E

[56] References Cited

U.S. PATENT DOCUMENTS

| | | | |
|---|---|---|---|
| 2,200,977 | 5/1940 | Baxter | 426/95 |
| 2,600,566 | 6/1952 | Moffett | 426/234 |
| 2,714,070 | 7/1955 | Welch | 426/234 |
| 2,759,830 | 8/1956 | Touceda | 426/132 |
| 2,864,932 | 12/1958 | Forrer | 426/243 X |
| 2,902,371 | 9/1959 | Shorr | 426/132 |
| 3,042,532 | 7/1962 | Daline | 426/412 |
| 3,539,354 | 11/1970 | Colvin | 426/113 |
| 3,623,892 | 11/1971 | Koonz et al. | 426/132 |
| 3,830,944 | 8/1974 | Dimitriadis et al. | 426/113 |
| 3,881,023 | 4/1975 | Wilson | 426/132 |
| 3,924,009 | 12/1975 | Goldberg | 426/132 |

FOREIGN PATENT DOCUMENTS

| | | | |
|---|---|---|---|
| 479968 | 1/1952 | Canada | 426/114 |

*Primary Examiner*—Steven L. Weinstein

*Attorney, Agent, or Firm*—James V. Harmon; Michael D. Ellwein

[57] ABSTRACT

A package is provided for heating foods which includes a pair of bread slices such as the halves of a hamburger bun, at least one meat product such as a hamburger patty preferably resting on one of the bread slices and a condiment package containing one or more condiments with a microwave reflective material at least partially enclosing the condiments to reduce the rate at which they absorb heat. These components are enclosed in a sealed plastic bag which is transparent to microwave energy.

8 Claims, 3 Drawing Figures

FOOD PACKAGE INCLUDING CONDIMENT CONTAINER FOR HEATING FOOD

This is a continuation of application Ser. No. 656,560 filed Feb. 9, 1976, and now abandoned, which is in turn a continuation of application Ser. No. 456,924 filed Apr. 1, 1974, and now abandoned.

FIELD OF THE INVENTION

The present invention relates to food packages and more particularly food packages designed to facilitate the heating of foods to serving temperature.

The Prior Art

In heating frozen or refrigerated foods such as hamburger sandwiches, the two main problems encountered in microwave heating are that first the buns heat much faster than the hamburger meat patty and second, the condiments because of their high moisture content become over-heated and are either excessively cooked or so hot that they can burn the person eating the sandwich even though the meat patty is only moderately hot. Condiments such as ketsup, mustard, pickles, cheese, etc. are especially a problem in the preparation of hamburgers in a microwave oven. The high rate at which they absorb microwave energy brings their final temperature to about 200° F. while the meat patty temperature is often only about 140° F. or less.

Another persistent problem is moisture migration. In storage and during heating, there is a tendency for water to move from the condiments into the bun. This makes for a soggy bun and slimy, viscous condiments.

Another area where problems sometimes exist is at the interface between the condiment and the meat. During prolonged storage there is a likelihood for an undesirable reaction between the meat and the condiments.

OBJECTS OF THE PRESENT INVENTION

The primary objects of the invention are to provide a package for storing and heating foods to serving temperature in both conventional and microwave ovens with the following characteristics: a) a faster heating cycle especially in conventional ovens, b) a means for preventing the condiments from being over-heated (especially in microwave heating) or from spreading out and soaking the bread or discoloring the meat, c) more even heating viz. means for facilitating heating of the meat to thereby reduce drying of the bun especially in conventional infra-red ovens, e) provision by which the heated product can be made into a sandwich easier and simpler than heating a sandwich and condiments separately, f) suitability for heating from the frozen state as well as from refrigerated storage, g) reducing moisture migration from condiments to the bread and h) reduction in undesired reaction between condiments and meat.

THE FIGURES

SUMMARY OF THE INVENTION

Briefly, a package is provided for heating foods which includes at least one and typically a pair of bread slices, another food product, preferably resting on one of the bread slices and a condiment package containing one or more condiments with a microwave reflective material at least partially enclosing the condiments to reduce the rate at which they absorb heat.

DESCRIPTION OF A PREFERRED EMBODIMENT

While the invention is suited for use in heating food products in both conventional infra-red ovens and microwave ovens it will be described in connection with the latter.

Figure 1:
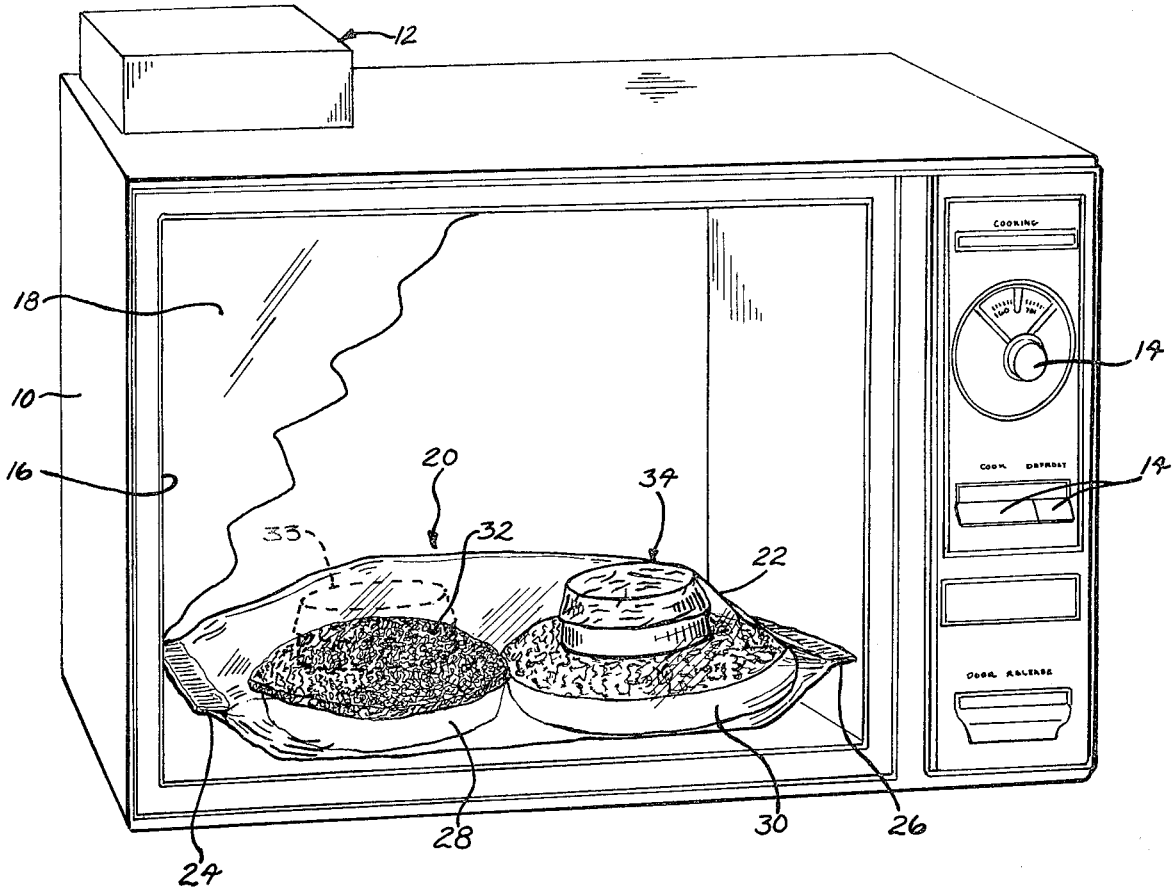
FIG. 1 is a perspective view of the package during heating in a microwave oven.

As seen in FIG. 1, the microwave oven 10 includes the usual microwave generating unit 12, controls 14, oven chamber 16 and door 18. Within the oven chamber 16 is a package 20 embodying the invention. The package 20 includes an enclosure 22, in this case a microwave transparent bag having sealed ends 24 and 26 and formed from a transparent plastic resinous film such as a polyester film. Because the bag 22 is sealed, it retains moisture and steam evolved during heating thereby distributing the heat more uniformly throughout the sandwich and helps to prevent the drying out of the buns 28 and 30. Within the bag 22 is the food product consisting in this case of a hamburger sandwich. The invention is, however, applicable to a variety of other foods such as meat spread sandwiches, sliced meat sandwiches, fish sandwiches, ham and cheese sandwiches, as well as sandwiches made with bologna, sausage and other meats processed in casings. The sandwich includes a pair of bread slices 28 and 30 which in this instance comprise the halves of a sliced hamburger bun with a meat patty 32 resting on a slice 28 and a condiment package 34 resting on the bun 30. The numeral 33 designates an alternate position for the condiment package 34 on top of the meat patty 32. The term "bread slice" is intended to have broad significance and refers both to the slices of an ordinary size loaf of bread as well as a hamburger bun which is sliced once through its center.

Figure 2:
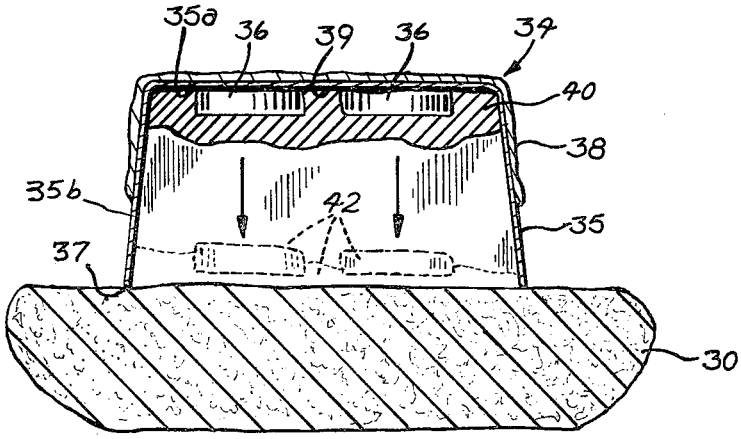
FIG. 2 is a vertical cross-sectional view of the condiment package and bread slice.
Figure 3:
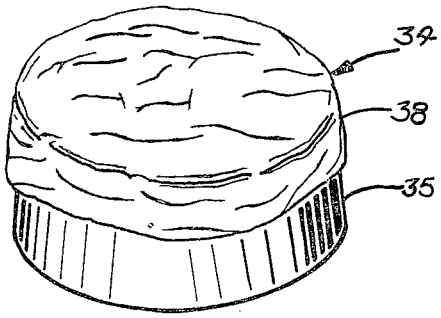
FIG. 3 is a perspective view of the condiment package.

The condiment package 34, as seen in FIGS. 2 and 3, comprises a vessel or container such as inverted cup 35 having an open mouthed top 37, the cup being inverted with the open mouth 37 facing downwardly and the bottom of the cup **35*a* being located furthest from the bun 30. The cup 35 comprises a flat circular bottom wall 35*a* and a generally cyclindrical side wall 35*b* both formed from paper, paperboard or other suitable sheet material transparent to microwave energy. The condiments such as pickles 36 and ketsup 40 is adhered by being frozen at 39 to the bottom wall 35*a* of the cup 35. Enclosing the bottom end of the cup (its upward end as seen in the figures) is a layer of microwave reflective material such as a metal foil 38 which extends across the entire circular bottom wall 35*a* and half way up the side of the cup thereby enclosing the condiments when in their frozen solid-line position in FIG. 2** so as to limit their exposure to microwave energy.

During heating, the condiments 36 and 40 to absorb microwave energy at a relatively slow rate but soon become melted whereupon they fall from the position shown in solid lines in FIG. 2 to the position 42 where they are heated at a more rapid rate since they are exposed on the sides to microwave energy. In this way the condiments can be reliably heated without being overheated.

The package is quite effective in preventing the overheating of the condiments and the transfer or moisture from the condiments into the bread slice or meat patty. The package is suitable for use in connection with microwave ovens or conventional infra-red ovens and provides much more uniform heating of the meat patty and bread. The sandwich is made ready to eat simply by removing the slices from the package and placing the slice of bread with the condiments on top of the meat patty.

When sandwiches are heated in conventional ovens, especially from the frozen state, the concept of this invention also allows far better reconstitution than that provided by the prior art. Specifically, heating times are significantly decreased and development of bun hardness or bread drying are significantly decreased, as shown in the data of Table I for ham and cheese sandwiches.

TABLE I

REHEATING FROZEN HAM AND CHEESE SANDWICHES IN AN INFRA-RED OVEN*

| Sandwich Composition | Orientation of Sandwich | Reconstitution Time Minutes | | | Average Bun Hardness | | |
|---|---|---|---|---|---|---|---|
| | | NO BAG | OVEN BAG (INVENTION) | FOIL BAG | NO BAG | OVEN BAG (INVENTION) | FOIL BAG |
| A | Closed | 20.5 | 17.0 | 22.5 | 60 | 50 | 30 |
| B | Closed | 38.5 | 32.0 | 46.5 | 70 | 60 | 50 |
| A | Open } Invention | 6.5 | 6.0 | 15.0 | 23 | 5 | 3 |
| B | Open } Invention | 18.5 | 12.0 | 21.0 | 60 | 55 | 50 |

*All samples were heated in a G.E. electric oven, one sandwich reconstituted at a time, oven temperature 362± 12° F., next to top shelf, center of oven, thermocouples monitored "filling" temperature to 140° F.

It can be seen that the closed configuration required about 89% more time than open-face. Even less time is required for samples in a bag 22 of the kind shown in the figures. It was noted that the bun hardness due to drying is considerably greater in samples A and B than C and D.

The heating cycle time in the infra-red (conventional) oven is thus substantially faster than heating of a standard sandwich with condiments when assembled in the closed sandwich configuration.

It was discovered that when the invention is used with conventional (infra-red) ovens and the bread slices are placed in side by side relationship resting in the same plane as shown, the meat patty 32 absorbs energy at a faster rate thereby helping to assure that the meat product will be heated before the bread slices become burned.

The difference in temperature of various parts of a sandwich, with and without the condiment cup in accordance with the invention (FIGS. 1–3) is depicted in Table II. It should be kept in mind that when the condiment temperature is above about 160° F. it will usually produce a nasty burn when the sandwich is eaten.

The best results are with Sample C. In Sample C, the cup foil dimensions are as follows: the cup is ⅜ inches high and 3 inches in diameter. The foil covered the entire end portion of the bottom of the cup i.e. the closed end and extended ¼ inch away from the bottom on the side of the cup. As the height of the foil covered portion on the side of the cup is increased, the final temperature of the condiments is reduced and as the height of that part of the cup uncovered by foil is increased, the higher will be the final patty temperature. By varying these two dimensions, nearly any combination of condiment and patty temperature is possible assuming free control of the heating time.

While the meat patty can comprise any food product other than bread (i.e. a non-farinaceous product), the invention has its greatest utility with proteinaceous products as the patty portion, including cheese, meat spreads and simulated meats such as those made from soy beans, etc.

What is claimed is:

1. A food package for storing and heating foods to serving temperature from a frozen or refrigerated state in both microwave and conventional ovens comprising: at least one food body comprising bread; a condiment container means resting on said food body, said condiment container means being inverted and having a bottom and side wall and a mouth facing downwardly; said condiment container means being formed from sheet material; a condiment adhered to the bottom wall of said condiment container means in spaced relationship above the food body whereby moisture migration is prevented from the condiment to the said food body when the condiment is thus adhered to the bottom wall of the condiment container means; a microwave reflective metallic sheet element enclosing at least a part of the condiment container means opposite the mouth to reduce the rate at which the condiment absorbs heat and said condiment being heat releasable from the condiment container means during heating in the oven and

TABLE II

SANDWICH TEMPERATURE WITH & WITHOUT CONDIMENT CUP 34 HEATING IN MICROWAVE OVEN

| Invention including condiment cup as described hereinabove* | | | Samples the same as A–D without condiment cup (condiments placed directly on meat patty | | |
|---|---|---|---|---|---|
| Sample | Patty Temperature | Condiments Temperature | Sample | Patty Temperature | Condiments Temperature |
| A | 113° F±45° F | 45° F±17° F | E & F | 140° F–150° F | Cheese 200° F |
| B | 129° F±40° F | 95° F±25° F | | | Ketchup, mustard & pickles 175° F |
| C | 123° F±47° F | 125.5° F±10° F | | | Tomatoes, lettuce & mayonnaise 190° F |
| D | 125° F±36° F | 81° F±23° F | | | |

*The height of the shielding foil on the sides of cup 34 was varied slightly in each of Samples A–D.

being free to fall to the mouth of the condiment container means onto the food body comprising bread where microwave energy can be absorbed at a faster rate whereby the exposure of the condiment to microwave energy is initially limited thereby preventing overheating of the condiment during the initial heating of the bread and a microwave transparent container enclosing said food body and said condiment container means.

2. The package of claim 1 wherein the package is frozen and the condiment is frozen to the inner surface of the bottom of the container and is released when partially thawed during heating in the oven and allowed to fall to the mouth of the cup where microwave energy is absorbed at a faster rate.

3. The food package of claim 1 wherein the condiment container comprises a cup having a circular cross-sectional shape, said cup having a bottom wall at the end opposite the top thereof with the free edge of the side walls thereof resting upon the meat product and the microwave reflective metallic sheet element comprising a metal foil bonded to the bottom of the cup and approximately half of the side wall of the cup extending from the bottom toward the free edge of the cup.

4. A food package and condiment container for storing and heating foods to serving temperature from a frozen or refrigerated state in both microwave and conventional ovens comprising: a pair of bread slices in side-by-side relationship lying in the same plane, a non-farinaceous food product resting on at least one of the bread slices, the food product comprising a member selected from the group consisting of a piece of meat or meat spread, a condiment container resting upon either one of the bread slices or the food product, the condiment container being inverted, being transparent to microwave energy and having a bottom wall, a side wall, an open mouth, said open mouth facing downwardly and a microwave reflective metallic sheet element enclosing at least a part of the condiment container opposite the mouth to reduce the rate at which the condiment absorbs heat, and a condiment frozen to the inner surface of the part of the condiment container adjacent the metallic sheet, said condiment being capable of being released during heating in the oven and being free to fall to the mouth of the condiment container where microwave energy can then be absorbed at a faster rate whereby the exposure of the condiment to microwave energy is limited thereby preventing overheating of the condiment during the heating of the food product and the bread slices and a microwave transparent, flexible bag enclosing the bread slices, the food product and the condiment container.

5. A food package and condiment container for storing and heating foods to serving temperature from a frozen or refrigerated state in both microwave and conventional ovens comprising: a pair of bread slices, a non-farinaceous food product resting upon at least one of the bread slices, the food product comprising a member selected from the group consisting of a piece of meat or meat spread, a condiment container resting upon either one of the bread slices or the food product, the condiment container being inverted, being transparent to microwave energy and having an open mouth facing downwardly and a microwave reflective metallic sheet element enclosing at least a part of the condiment container opposite the mouth to reduce the rate at which the condiment absorbs heat, and a condiment frozen to the inner surface of the part of the condiment container adjacent the metallic sheet, said condiment being released during heating in the oven and being free to fall to the mouth of the condiment container where microwave energy can then be absorbed at a faster rate whereby the exposure of the condiment to microwave energy is limited thereby preventing overheating of the condiment during the heating of the food product and the bread slices and a microwave transparent, flexible bag enclosing the bread slices, the food product and the condiment container.

6. The package of claim 1 wherein the bag is a plastic resinous film sealed to prevent the escape of steam evolved during heating.

7. A food package for storing and heating foods to serving temperature from a frozen or refrigerated state in a microwave oven comprising: at least one farinaceous bready food body within the package, said package including a condiment container means above the farinacous bready food body, said condiment container means being inverted and having bottom and side walls and being formed from sheet material and the bottom wall facing the food body and being spaced thereabove, a condiment adhered to the bottom wall of the condiment container means in spaced relationship above the food body whereby moisture migration is prevented from the condiment to the food body when the condiment is thus adhered to the bottom wall of the condiment container means, microwave reflective means enclosing and shielding at least a portion of the condiment container means to reduce the rate at which the condiment absorbs heat and said condiment being heat releasable from the condiment container means during heating in the oven and being free to fall from said bottom wall and to drop onto the bready farinaceous food body where microwave energy can be absorbed at a faster rate whereby the exposure of the condiment to microwave energy is initially limited, thereby preventing overheating of the condiment during initial heating of the farinaceous bready food body and said package comprising a microwave transparent container means enclosing the food body and said condiment container means being within the package above the food body.

8. The package of claim 7 wherein the condiment container comprises a cup within the package resting upon the bready food body.

* * * * *